US010533552B2

(12) United States Patent
Schofield

(10) Patent No.: US 10,533,552 B2
(45) Date of Patent: Jan. 14, 2020

(54) ROTARY SCREW VACUUM PUMPS

(71) Applicant: Edwards Limited, Burgess Hill, Sussex (GB)

(72) Inventor: Nigel Paul Schofield, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 266 days.

(21) Appl. No.: 15/538,314

(22) PCT Filed: Nov. 10, 2015

(86) PCT No.: PCT/GB2015/053401
§ 371 (c)(1),
(2) Date: Jun. 21, 2017

(87) PCT Pub. No.: WO2016/102916
PCT Pub. Date: Jun. 30, 2016

(65) Prior Publication Data

US 2018/0023566 A1 Jan. 25, 2018

(30) Foreign Application Priority Data

Dec. 23, 2014 (GB) ..... 1423129.4

(51) Int. Cl.
*F04C 18/16* (2006.01)
*F04C 25/02* (2006.01)
(Continued)

(52) U.S. Cl.
CPC ..... *F04C 18/16* (2013.01); *F04C 25/02* (2013.01); *F04C 29/0007* (2013.01); *F04C 29/128* (2013.01); *F04C 2240/20* (2013.01)

(58) Field of Classification Search
CPC ..... F04C 27/02; F04C 29/0007; F04C 18/16; F04C 29/128; F04C 2240/20
See application file for complete search history.

(56) References Cited

U.S. PATENT DOCUMENTS 1,430,894 A 10/1922 Fay
2,929,550 A 3/1960 Sadler
(Continued)

FOREIGN PATENT DOCUMENTS

CN 1445457 A 10/2003
CN 102182680 A 12/2012
(Continued)

OTHER PUBLICATIONS

British Search Report and Examination Report under Sections 17 and 18(3) dated Jun. 23, 2015 in GB Application GB 1423129.4, 9 pgs.
(Continued)

*Primary Examiner* — Mary Davis
(74) *Attorney, Agent, or Firm* — Shumaker & Sieffert, P.A.

(57) ABSTRACT

A rotary screw vacuum pump 10 comprises a housing 12 that has a lower pressure inlet region 14 and a higher pressure outlet region 16 and two intermeshing screws 18 disposed in the chamber and configured to cooperably rotate to compress a gas in working chambers formed between them and the housing while pumping the gas from the lower pressure inlet region to the higher pressure outlet region. The housing 12 has a least one liquid inlet 20 to admit a sealing liquid to seal the working chambers. The intermeshing screws 18 comprise Quimby-type screws.

20 Claims, 3 Drawing Sheets

(51) Int. Cl.
*F04C 29/12* (2006.01)
*F04C 29/00* (2006.01)

(56) References Cited

U.S. PATENT DOCUMENTS

| | | | | |
|---|---|---|---|---|
| 3,558,248 | A | 1/1971 | Parker | |
| 3,885,402 | A * | 5/1975 | Moody, Jr. | F04C 28/125 418/201.2 |
| 3,936,249 | A * | 2/1976 | Sato | F04C 29/0007 418/88 |
| 6,368,091 | B1 * | 4/2002 | Mito | F04C 18/16 418/150 |
| 6,375,443 | B1 | 4/2002 | Yoshimura | |
| 8,469,684 | B2 | 6/2013 | Figoni | |
| 2002/0131884 | A1 | 9/2002 | Mito et al. | |

FOREIGN PATENT DOCUMENTS

| | | | |
|---|---|---|---|
| DE | 19817351 | A1 | 10/1999 |
| EP | 1464497 | A1 | 10/2004 |
| KR | 101450507 | B1 | 10/2014 |

OTHER PUBLICATIONS

International Search Report and Written Opinion dated Feb. 2, 2016 in corresponding International Application No. PCT/GB2015/053401, 13 pgs.

* cited by examiner

ROTARY SCREW VACUUM PUMPS

CROSS REFERENCE OF RELATED APPLICATION

This Application is a Section 371 National Stage Application of International Application No. PCT/GB2015/053401, filed Nov. 10, 2015, which is incorporated by reference in its entirety and published as WO 2016/102916 A1 on Jun. 30, 2016 and which claims priority of British Application No. 1423129.4, filed Dec. 23, 2014.

FIELD

The invention relates to rotary screw vacuum pumps.

BACKGROUND

For basic low cost pumping operations in scientific and industrial markets at rates of up to about 600 $m^3$/hr, the rotary vane pump is still the most commonly used form of vacuum pump. Rotary vane pumps run relatively slowly due to the forces acting on the vanes, which are spring-biased into engagement with a cylindrical wall of the rotor chamber. Rotary screw vacuum pumps may run at higher speeds.

A rotary screw vacuum pump may comprise a housing containing two intersecting bores in which are housed a pair of intermeshing screw rotors. The ends of the housing are closed and provided with suction (inlet) and exhaust (outlet) ports. Working chambers are formed between the walls of the bores and meshing surfaces of the screw rotors. When the screw rotors rotate, the working chambers travel axially along the housing and are progressively limited as they approach the exhaust port end of the housing so that a pulsing pumping action is obtained. Such rotary screw vacuum pumps may be provided with an oil supply system to deliver oil to the screw rotors for lubrication and sealing purposes. Known oil sealed rotary screw vacuum pumps use a Lysholm type screw design that has multiple starts. Typically the screw rotors have at least four starts. The combination of high rotational speeds of the screw rotors and multi-start threads produces a rapidly pulsating output at the exhaust port.

The discussion above is merely provided for general background information and is not intended to be used as an aid in determining the scope of the claimed subject matter. The claimed subject matter is not limited to implementations that solve any or all disadvantages noted in the background.

SUMMARY

A rotary screw vacuum pump includes a housing having a lower pressure inlet region and a higher pressure outlet region and two intermeshing screw rotors disposed in the housing and configured to cooperably rotate to compress a gas in working chambers formed between said screw rotors and said housing while pumping said gas from said lower pressure inlet region to said higher pressure outlet region. The housing has at least one inlet to admit a liquid into said housing to seal said working chambers, and the intermeshing screw rotors are Quimby-type screw rotors.

In accordance with a further embodiment, a rotary screw vacuum pump includes a housing having walls defining a rotor chamber and two intermeshing screw rotors in said rotor chamber that are configured to cooperably rotate to compress a gas in working chambers formed between respective threads of said screw rotors and at least one said wall, each said thread having a crest, a root, a first flank and a second flank, said first and second flanks extending from said crest to said root and said second flank comprising a concave cross section. An exhaust port for receiving compressed gas from the working chambers is provided with an exhaust valve operable to prevent gas entry to the rotor chamber via the exhaust port. A liquid feed system is operable to feed a liquid into the rotor chamber to seal the working chambers.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

In the disclosure that follows, reference will be made to the drawings in which.

DETAILED DESCRIPTION

Figure 1:
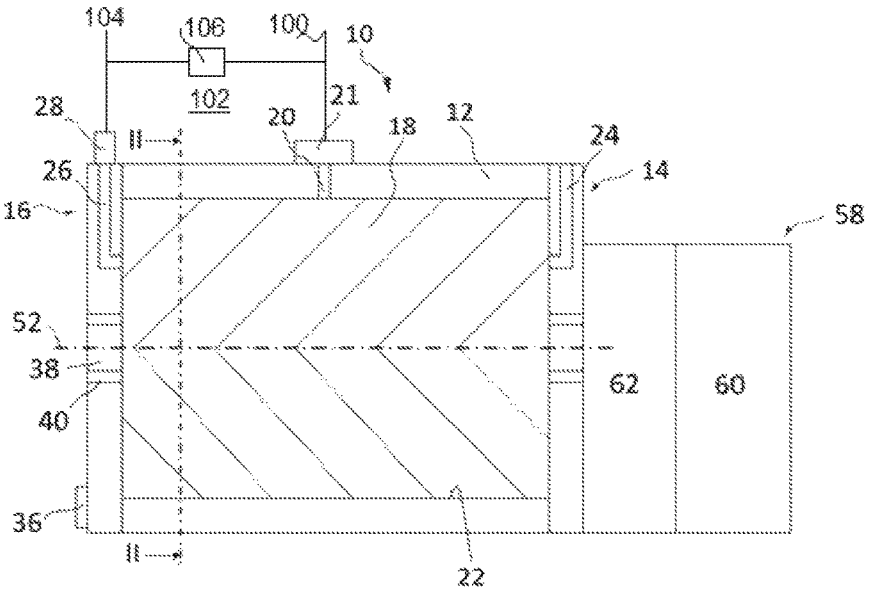
FIG. 1 is a schematic side elevation view of a rotary screw vacuum pump.
Figure 2:
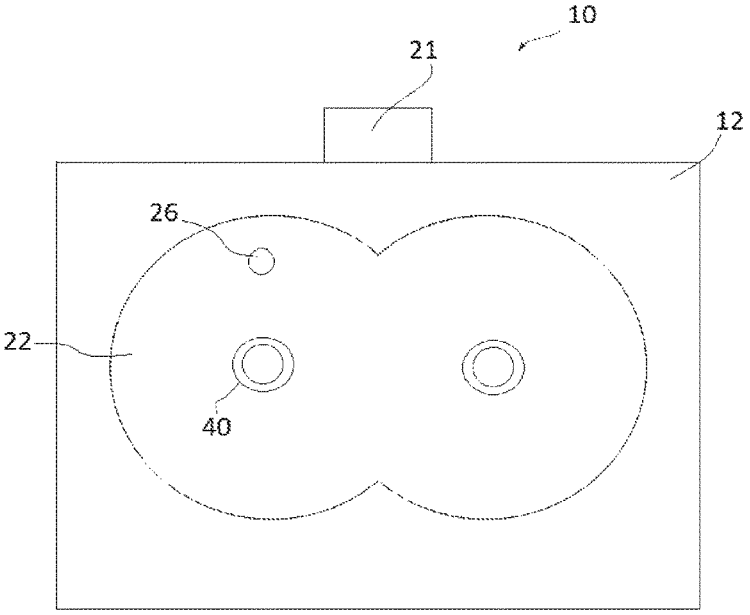
FIG. 2 is a schematic end view of the rotary screw vacuum pump looking on line II-II in FIG. 1 with its screw rotors removed.
Figure 3:
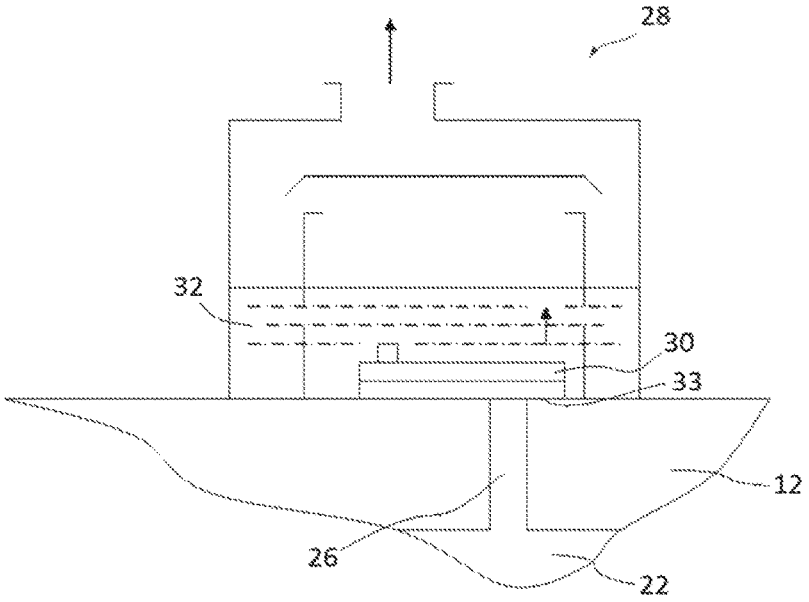
FIG. 3 is a schematic representation of an exhaust valve of the rotary screw vacuum pump.

Referring to FIGS. 1 to 3, a rotary screw vacuum pump 10 comprises a housing 12 that has a lower pressure inlet region 14 and a higher pressure outlet region 16. In the illustrated example the regions 14, 16 are disposed at opposite ends of the housing 12. The rotary screw vacuum pump 10 further comprises two intermeshing screw rotors 18 disposed in the housing 12 and configured to cooperably rotate to compress a gas in working chambers formed between them and the housing 12 while pumping the gas from the inlet region 14 to the outlet region 16. The intermeshing screw rotors 18 comprise Quimby-type screw rotors. The housing 12 has a least one oil inlet 20 to admit oil into the housing to seal the working chambers. The at least one oil inlet 20 is connected with a source of oil 21. Although not essential, in the illustrated example the oil inlet 20 is disposed approximately midway between the ends of the two screw rotors 18 over a position at which the threads of the screw rotors come together to form a working chamber.

The housing 12 may take any convenient form and may, for example, comprise a plurality of castings made of a suitable metal. As best seen in FIGS. 1 and 2, the housing 12 defines a longitudinally extending chamber 22 comprising two axially parallel intersecting bores. A suction port 24 is provided at the inlet end region 14. The suction port 24 is configured to route suction pressure gas into the chamber 22. An exhaust port 26 is provided at the outlet end region 16. The exhaust port 26 is configured to route higher pressure pumped gas from the chamber 22 to a location exterior to the pump. The exhaust port 26 is provided with a non-return exhaust valve 28. In the illustrated example, the exhaust valve 28 comprises a movable valve element 30. The valve element 30 is disposed in an oil bath 32 that in use contains oil that floods the seal made by a valve element and a valve seat 33 defined around the exhaust port 26. The movable valve element 30 may comprise a flap valve made of metal or rubber. In the example illustrated in FIG. 3, the movable valve element 30 comprises a rubber reed backed by a metal biasing element configured to bias the rubber reed to a closed position in which it is pressed against a valve seat 33 defined around the exhaust port 26. As one alternative to a flap valve, the movable valve element 30 may comprise a disc slideable on a rod that extends through the disc and positions and guides the disc for movement relative to the valve seat. Vacuum pump non-return exhaust valves, including oil immersed valves and reed valves, will be known to those skilled in the art and so will not be described in further detail herein.

The vacuum pump preferably comprises an oil recirculation system 102 for recirculating oil from the outlet 26, 28 to the pumping mechanism via oil inlet and oil source 20, 21. The oil recirculation system 102 may comprise an oil cleaning device 106, such as a filter, to remove debris from the recirculated oil. The recirculation system 102 also preferably comprises a gas ballast 100 for supplying gas ballast such as air, nitrogen, or, if suitably unreactive, recirculated exhaust gas. The addition of said gas ballast has the two-fold advantage of both promoting the removal of any dissolved solvent (e.g. water) from the recirculated oil and, by forming very small bubbles in the oil, preventing hydraulic lock at the high pressure end of the pump 16. The recirculation system 102 may also comprise an exhaust gas/oil separator (not shown) to separate the exhaust gas from the oil such that the oil is recirculated to the oil inlet and source 20, 21 and the exhaust gas is exhausted via 104.

The Quimby type screw rotors 18, which are well known to those skilled in the art, may be defined by hollow bodies mounted on respective shafts 38. The shafts 38 are configured to protrude beyond the opposed ends of the screw rotors 18 to provide respective end hearing portions that seat in bearings 40 mounted in the housing 12. The screw rotors 18 are disposed with their shafts 38 in axially parallel relation.

Figure 4:
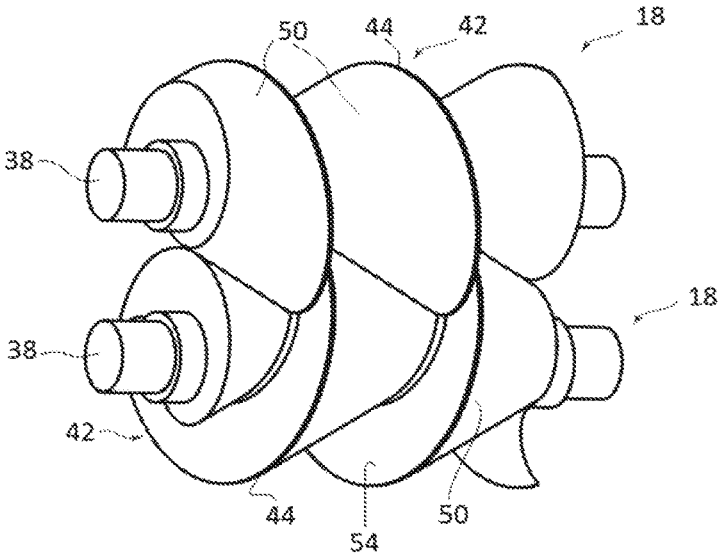
FIG. 4 is a perspective view of intermeshing screw rotors of the rotary screw vacuum pump.
Figure 5:
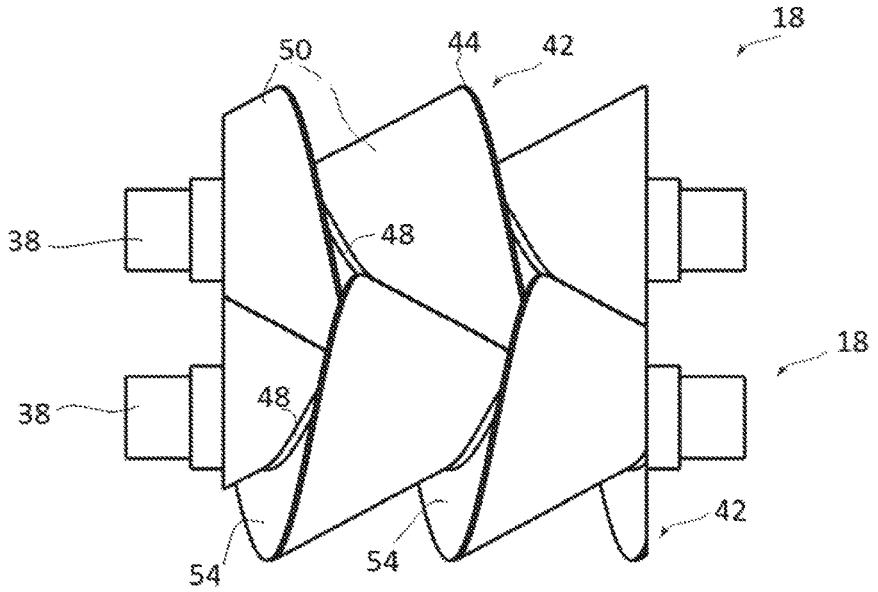
FIG. 5 is a side elevation of the intermeshing screw rotors.
Figure 6:
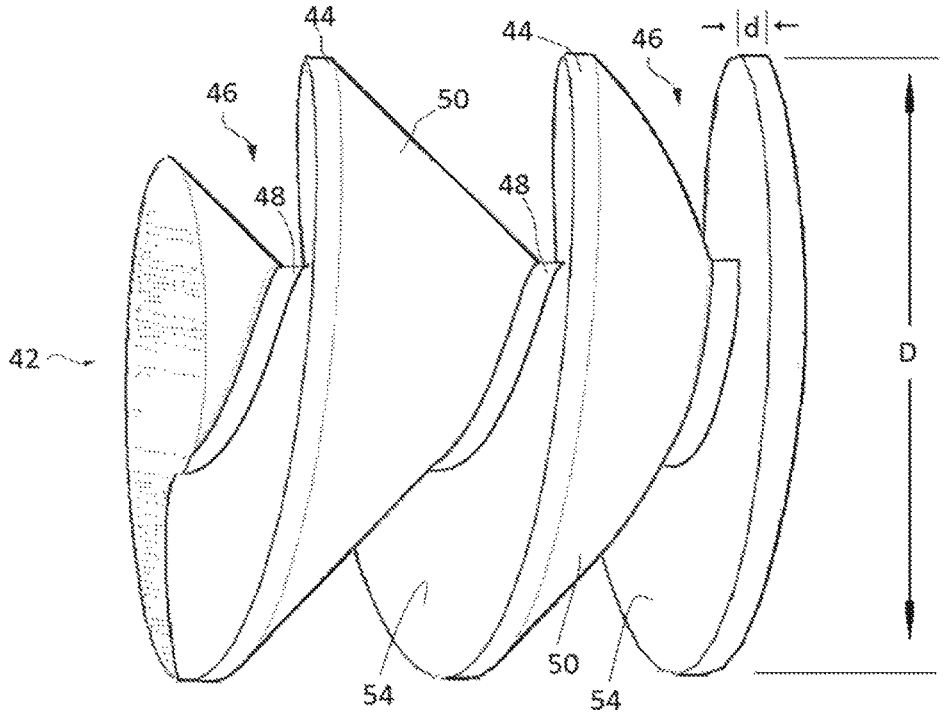
FIG. 6 shows detail of one of the screws.

As best seen in FIGS. 4 to 6, the screw rotors 18 each comprise a single start thread 42. Each thread 42 has a flat crest 44 corresponding to the shape of the spiral section of a cylinder. A spiralling groove 46 is defined between the opposed flanks of the thread 42. The groove 46 has a bottom or thread root 48 that is at least substantially flat and a width that corresponds substantially to the width of the crest 44. There is a small difference in the widths of the crest 44 and the thread root 48 to provide sufficient operational running clearance between the threads 42 of the intermeshing screw rotor 18. The first, or front, flank 50 of each thread 42 is inclined to the longitudinal axis 52 (FIG. 1) of the screw rotors 18 and has a generally flat cross-section or profile. Thus, in the illustrated example a line extending between the crest 44 and root 48 and disposed in a plane extending through the axis of rotation of the screw rotor will be a straight line. The second, or rear flank, 54 of each thread 42 is hollowed so as to comprise a concave cross section or profile that defines a continuous spiralling recess extending in the lengthways direction of the thread. Thus, a line extending between the crest 44 and root 48 and disposed in a plane extending through the axis of rotation of the screw rotor will curve progressively towards the first flank 50 and then away from the first flank over at least a part of its length. The concave cross section has a depth measured from a perpendicular to the longitudinal axis 52 which depth increases gradually in the direction from the crest 44 towards the thread root 48 and then decreases rapidly from a point near the root to the root. In the illustrated example, the concave cross section extends from the crest 44 to the thread root 48.

The screw rotors 18 each have a single start thread 42, As shown FIGS. 4 and 5, the screw thread 42 on one of the screw rotors 18 is a left hand screw thread, while the screw thread on the other screw rotor is a right hand screw thread and the screw rotors are arranged such that their respective first flanks 50 engage and their respective second flanks 54 are disposed in facing relation.

Referring to FIG. 6, the threads 42 have a major diameter D and the crests have a width d. The width d may be made relatively small when compared to the crest diameter D. The ratio of crest width d to crest diameter D may be up to 0.06, although it is believed better results may be achieved by providing a ratio of up to 0.02. A range of 0.01 to 0.03 is currently believed to be optimal so that for a crest diameter of 100 mm, a crest width of 1 mm to 3.0 mm will provide desirable results. Ensuring that the crest width d is not overly wide when compared to the crest diameter D, so that the threads 42 have a relatively narrow peripheral edge, minimises oil sheer and power losses that may be encountered when a relatively wide crest is used thereby allowing the use of relatively larger diameter screw rotors or relatively high rotational rotor speeds (RPM). This allows the design of rotary screw vacuum pumps having a relatively higher potential throughput. If a relatively wider crest is used that the ratios provided above then the oil shear at the crest will be high and the pump becomes inefficient. The crest diameter D has been found to be most applicable to the present invention at between 50 mm and 300 mm, preferably between 80 mm and 180 mm.

In the illustrated example, the rotary screw vacuum pump 10 is provided with a drive unit 58 that comprises an electric motor 60 and gearing 62. The shafts 38 extend through the inlet end of the housing 12 to connect with the gearing 62. The gearing 62 may include a first spur gear fixed to a primary one of the shafts 38 and a second spur gear of the same size fixed to the other of the shafts and driven by the spur gear on the primary shaft to ensure that the screws 18 rotate at the same speed. In some examples the first and second spur gears may engage directly. The spur gears can thus be regarded as synchronising gears. In other examples, the drive unit 58 may comprise a pulley or similar drive receiving device, rather than an electric motor 60.

In the illustrated example, the at least one oil inlet 20 and oil source 21 comprise an oil feed system to supply oil to lubricate the screw rotors and seal the working chambers defined between the screw rotors and walls of the chamber 22. It is to be understood that the arrangement shown is given purely by way of example and any system by means of which a suitable supply of liquid, or lubricant, can be introduced into the chamber 22 may be used.

In the illustrated example, the suction and exhaust ports are shown disposed in the ends of the housing 12 opposite the end faces of the screw rotors 18. It is to be understood that this is simply by way of illustration and that the suction or exhaust port, or both of them, may be arranged such that they open into the chamber 22 at a position over the circumference of a screw rotor(s).

In use of the rotary screw vacuum pump 10, the electric motor 60 is energised to cause the screw rotors 18 to rotate. The gearing arrangement 62 ensures that the screw rotors 18 rotate synchronously. Suction pressure gas is drawn into the chamber 22 through the suction port (inlet) 24 from a location that is being pumped, for example a process chamber. Pockets of the gas are trapped in working chambers that form between the screw rotors 18 and the walls of the chamber 22. As the screw rotors 18 rotate, the working chambers travel axially along the pump towards the exhaust port 26. The working chambers are progressively limited in volume as the exhaust port 26 is approached so that the gas is compressed and a relatively higher pressure gas is expelled from the chamber 22 via the exhaust port (outlet) 26. The pressure of the compressed gas is sufficient to raise the valve element 30 from its closed position so that the gas is exhausted from the rotary screw vacuum pump 10. As each working chamber reaches the position at which its gas content is expelled into the exhaust port, the movable valve element 30 is lifted to allow the exhausting of the gas and once the gas has been exhausted the valve element automatically returns towards its closed position under its own bias to close the exhaust port. The effect of the exhaust valve 28 is to ensure that relatively higher pressure gas is not sucked back into the valve after the exhausting of the pockets of higher pressure gas. Exhaust valves, if excessively worked, for example with a high pulsation frequency such as that provided by a multi-start screw form, are both ineffective and/or prone to wear damage. An advantage of being able to using the single start thread 42 of the present invention, as shown in the illustrated examples, is that the screw rotors 18 deliver a single pulse of compressed gas per revolution. This low pulsation frequency enables the effective use of a, previously ineffective, exhaust valve and provides lower power and noise levels, particularly when the pump is operating at low suction pressures.

It is envisaged that a rotary screw vacuum pump such as that illustrated by FIGS. 1 to 6 with 2 to 2½ turns per screw (between the inlet and outlet) can achieve vacuum levels of between 1 mbar and 0.01 mbar, ideally 0.1 mbar, and such a pump provided with 100 mm diameter rotary screws may provide throughputs of between 40 $m^3$/hr to 100 $m^3$/hr, ideally 60 $m^3$/hr at a rotational frequency of 3000 RPM.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A rotary screw vacuum pump comprising:

a housing having a lower pressure inlet region and a higher pressure outlet region; and two intermeshing screw rotors disposed in the housing and configured to cooperably rotate to compress a gas in working chambers formed between the screw rotors and the housing while pumping the gas from the lower pressure inlet region to the higher pressure outlet region, wherein:

the housing has at least one inlet to admit a liquid into the housing to seal the working chambers, the intermeshing screw rotors comprise Quimby screw rotors, and the intermeshing screw rotors each comprise a thread having a substantially flat crest and the ratio of the crest width to thread major diameter is not substantially greater than 0.06.

2. The rotary screw vacuum pump as claimed in claim 1, further comprising an exhaust port provided with a non-return exhaust valve, the exhaust port being disposed at the higher pressure outlet region.

3. The rotary screw vacuum pump as claimed in claim 2, wherein the non-return exhaust valve comprises a flap valve.

4. The rotary screw vacuum pump as claimed in claim 2, further comprising an oil bath arranged to hold a liquid to immerse the non-return exhaust valve.

5. The rotary screw vacuum pump as claimed in claim 1, wherein the ratio is not substantially greater than 0.04.

6. The rotary screw vacuum pump as claimed in claim 5, wherein the ratio is in the range 0.01 to 0.03.

7. The rotary screw vacuum pump as claimed in claim 1, wherein the major diameter is between 50 and 300 mm.

8. The rotary screw vacuum pump as claimed in claim 1, wherein the liquid comprises oil.

9. A rotary screw vacuum pump comprising:

a housing having walls defining a rotor chamber;

two intermeshing screw rotors in the rotor chamber that are configured to cooperably rotate to compress a gas in working chambers formed between respective threads of the intermeshing screw rotors and at least one of the walls, each of the threads having a crest, a root, a first flank and a second flank, the first and second flanks extending from the crest to the root and the second flank comprising a concave cross section;

an exhaust port to receive compressed gas from the working chambers and provided with an exhaust valve operable to prevent gas entry to the rotor chamber via the exhaust port; and a liquid feed system operable to feed a liquid into the rotor chamber to seal the working chambers, wherein the ratio of the crest width to thread major diameter of the threads is not substantially greater than 0.06.

10. The rotary screw pump as claimed in claim 9, wherein the concave cross section defines a recess in the second flank that extends continuously in a lengthways direction of the thread.

11. The rotary screw vacuum pump as claimed in claim 9, wherein the crests and roots are at least substantially flat.

12. The rotary screw vacuum pump as claimed in claim 9, wherein the concave cross section of each second flank extends from the crest to the root of the thread.

13. The rotary screw vacuum pump as claimed in claim 9, wherein the ratio is not substantially greater than 0.04.

14. The rotary screw vacuum pump as claimed in claim 13, wherein the ratio is in the range 0.01 to 0.03.

15. The rotary screw vacuum pump as claimed in claim 9, wherein the major diameter is between 50 and 300 mm.

16. The rotary screw vacuum pump as claimed in claim 9, wherein the intermeshing screw rotors are arranged such that their respective first flanks engage during the cooperable rotation of the intermeshing screw rotors.

17. The rotary screw vacuum pump as claimed in claim 9, wherein the first flanks have a substantially flat cross section.

18. The rotary screw vacuum pump as claimed in claim 9, wherein the exhaust valve is a flap valve.

19. The rotary screw vacuum pump as claimed in claim 9, further comprising a liquid bath arranged to hold a liquid to immerse a sealing element of the exhaust valve.

20. The rotary screw vacuum pump as claimed in claim 9, wherein the liquid comprises oil.

* * * * *